US009643431B2

(12) United States Patent
Hoshino

(10) Patent No.: US 9,643,431 B2
(45) Date of Patent: May 9, 2017

(54) JAM DETECTION DEVICE, CONVEYING DEVICE, IMAGE RECORDING APPARATUS, AND CONNECTION STATUS DETECTION METHOD

(71) Applicant: Fujifilm Corporation, Tokyo (JP)

(72) Inventor: Shuhei Hoshino, Kanagawa (JP)

(73) Assignee: FUJIFILM Corporation, Tokyo (JP)

( * ) Notice: Subject to any disclaimer, the term of this patent is extended or adjusted under 35 U.S.C. 154(b) by 0 days.

(21) Appl. No.: 15/096,335

(22) Filed: Apr. 12, 2016

(65) Prior Publication Data

US 2016/0221364 A1 Aug. 4, 2016

Related U.S. Application Data

(63) Continuation of application No. PCT/JP2014/076807, filed on Oct. 7, 2014.

(30) Foreign Application Priority Data

Oct. 15, 2013 (JP) ..... 2013-214883

(51) Int. Cl.
*B41J 29/38* (2006.01)
*B41J 11/00* (2006.01)

(52) U.S. Cl.
CPC ..... *B41J 11/006* (2013.01); *B41J 11/0095* (2013.01)

(58) Field of Classification Search
CPC combination set(s) only.
See application file for complete search history.

(56) References Cited

U.S. PATENT DOCUMENTS 4,310,153 A * 1/1982 Kikuchi ..... B65H 7/14 250/223 R
4,551,813 A * 11/1985 Sanbayashi ..... G03G 15/70 271/258.03

(Continued)

FOREIGN PATENT DOCUMENTS

JP 2005059569 A 3/2005
JP 2011173324 A 9/2011

(Continued)

OTHER PUBLICATIONS

Written Opinion of the International Searching Authority of PCT/JP2014/076807 mailed Dec. 16, 2014.

(Continued)

*Primary Examiner* — Matthew Luu
*Assistant Examiner* — Lily Kemathe
(74) *Attorney, Agent, or Firm* — Studebaker & Brackett PC

(57) ABSTRACT

The jam detection device includes: a board to which a first output signal, a second output signal, and a timing signal for defining detection timings thereof are input in response to passing of cut sheets; a first wiring through which the timing signal is input to the board; a second wiring through which a conveying synchronization signal of the conveying device is input to the board; a conveying error detection unit that is disposed on the board and detects conveying errors of the cut sheets by detecting conditions of the first output signal and the second output signal at the detection timings; and a connection status detection unit that is disposed on the board and detects a connection status of the first wiring by comparing the conveying synchronization signal with the timing signal.

11 Claims, 8 Drawing Sheets

(56) References Cited

U.S. PATENT DOCUMENTS 4,908,655 A * 3/1990 Takagi ..... G03G 15/55 340/675
4,996,557 A * 2/1991 Takagi ..... G03G 15/55 340/286.13
6,535,698 B2 * 3/2003 Horikoshi ..... B65H 7/00 399/16
6,585,437 B1 * 7/2003 Wiklof ..... B41J 3/4075 101/288
2001/0033753 A1 * 10/2001 Horikoshi ..... B65H 7/00 399/16
2002/0021914 A1 * 2/2002 Serizawa ..... G03G 21/1889 399/75
2003/0190169 A1 * 10/2003 Shibaki ..... G03G 15/6567 399/21
2005/0191066 A1 * 9/2005 Yamazaki ..... G03G 15/168 399/21
2008/0101804 A1 * 5/2008 Yoda ..... G03G 15/5004 399/21
2010/0091056 A1 * 4/2010 Miyagi ..... B41J 2/16526 347/9
2011/0205281 A1 8/2011 Saita
2012/0249648 A1 * 10/2012 Katayama ..... B41J 11/0095 347/16
2012/0274718 A1 * 11/2012 Houjou ..... B41J 11/0015 347/102
2013/0044151 A1 * 2/2013 Masuda ..... B41J 13/0009 347/16

FOREIGN PATENT DOCUMENTS

JP 2011203635 A 10/2011
JP 2012071916 A 4/2012
JP 2012213895 A 11/2012
WO 2015/056604 A1 4/2015

OTHER PUBLICATIONS

International Search Report of PCT/JP2014/076807 mailed Dec. 16, 2014.

* cited by examiner

FIG. 4A TIMING SIGNAL TM
ON
OFF
FIG. 4B FIRST SENSOR SIGNAL S1
ON
OFF
FIG. 4C FIRST DETECTION SIGNAL DS1
ON
OFF
FIG. 4D FIRST DELAYED DETECTION SIGNAL DD1
ON
OFF
FIG. 4E SECOND SENSOR SIGNAL S2
ON
OFF
FIG. 4F SECOND DETECTION SIGNAL DS2
ON
OFF
FIG. 4G JAM SIGNAL JFS
Fail
not Fail
MATCHING
MISMATCHING
FIG. 4H JAM CLEAR INPUT SIGNAL JRI
ON
OFF
FIG. 4I JAM DETERMINATION OUTPUT SIGNAL JFO
24V
0V(Jam)

JAM DETECTION DEVICE, CONVEYING DEVICE, IMAGE RECORDING APPARATUS, AND CONNECTION STATUS DETECTION METHOD

CROSS-REFERENCE TO RELATED APPLICATIONS

The present application is a Continuation of PCT International Application No. PCT/JP2014/076807 filed on Oct. 7, 2014 claiming priority under 35 U.S.C §119(a) to Japanese Patent Application No. 2013-214883 filed on Oct. 15, 2013. Each of the above applications is hereby expressly incorporated by reference, in their entirety, into the present application.

BACKGROUND OF THE INVENTION

1. Field of the Invention

The present invention relates to a jam detection device, a conveying device, an image recording apparatus, and a connection status detection method. In particular, the present invention relates to a technology of detecting a connection status of wirings for detecting conveyance errors in conveyance of cut sheets.

2. Description of the Related Art

In the past, there have been known ink jet recording apparatuses in which ink liquid droplets are ejected from nozzle holes of an ink jet head, and cut sheets of paper are used as recording media, and images are formed and recorded on recording surfaces of the sheets of paper. In such ink jet recording apparatuses, the sheets of paper are conveyed from a sheet feeding section to an image forming section, images are formed on the image forming section and are thereafter conveyed to a drying section, and the sheets of paper are heated and dried in the drying section and are thereafter discharged to a sheet discharging tray.

In a case where some errors occur in conveyance of sheets of paper, a sheet of paper may remain in the apparatus. Particularly, if a sheet of paper remains in a heat generation section such as a heater which is provided in the drying section, a problem arises in that the sheet of paper may be burned.

Regarding such a problem, JP2012-213895A describes a technology of detecting whether a sheet of paper remains in a heat generation section by detecting whether a sheet of paper enters and goes out at an appropriate timing through a sensor, which is for detecting the presence or absence of a sheet of paper in the heat generation section, and a sensor which is for controlling the timing of detecting the presence or absence of a sheet of paper in the heat generation section.

Further, JP2005-059569A describes a technology of detecting the presence or absence of a tray at an appropriate timing by controlling the timing on the basis of an amount of rotation of a roller.

SUMMARY OF THE INVENTION

However, regarding such a detection method, it is a premise that the apparatus is precisely configured. For example, in JP2012-213895A, in a case where a timing control signal is not input due to connector omission, connection failure, or the like, it is not possible to detect the presence or absence of a sheet of paper. Further, likewise, also in JP2005-059569A, in a case where a rotation amount detection signal is not input, it is not possible to specify a conveyance state of a tray.

The present invention has been made in consideration of such a situation. Therefore, an object of the present invention is to provide a jam detection device, a conveying device, an image recording apparatus, and a connection status detection method capable of preventing sheets of paper from remaining in the apparatus by detecting errors in wirings for signals for detecting conveying errors of the sheets of paper so as to reliably detect conveying errors of the sheets of paper.

In order to achieve the object, according to an aspect of the present invention, there is provided a jam detection device including: a synchronization signal generation unit that generates a conveying synchronization signal for synchronization with a conveying operation of a conveying device including a processing unit configured to process cut sheets while conveying the cut sheets, a first conveying unit configured to transfer the cut sheets to the processing unit, and a second conveying unit configured to receive the cut sheets from the processing unit; a first detection sensor that is provided to face the first conveying unit and outputs a first output signal in response to passing of the cut sheets; a second detection sensor that is provided to face the second conveying unit and outputs a second output signal in response to passing of the cut sheets; a timing signal generation unit that generates a timing signal for defining detection timings of the first output signal and the second output signal; a board to which the first output signal, the second output signal, and the timing signal are input; a first wiring through which the timing signal is input to the board; a second wiring through which the conveying synchronization signal is input to the board; a conveying error detection unit that is disposed on the board and detects conveying errors of the cut sheets by detecting conditions of the first output signal and the second output signal at the detection timings; and a connection status detection unit that is disposed on the board and detects a connection status of the first wiring by comparing the conveying synchronization signal with the timing signal.

According to the present aspect, the timing signal is input to the board, which has the conveying error detection unit that detects conveying errors of the cut sheets, through the first wiring, the conveying synchronization signal is input to the board through the second wiring, and the input timing signal and the conveying synchronization signal are compared, whereby detecting the connection status of the first wiring is detected. Therefore, it is possible to detect the wiring errors for signals for detecting the conveying errors of the sheets of paper.

It is preferable that the connection status detection unit detects errors in the first wiring in a case where there is no change in the timing signal while the conveying synchronization signal is detected a plurality of times. Further, the connection status detection unit may detect errors in the second wiring in a case where there is no change in the conveying synchronization signal while the timing signal is detected a plurality of times. Thereby, it is possible to appropriately detect the wiring errors.

The board and the first wiring may be connected through a connector, and the board and the second wiring may be connected through a connector. According to the present aspect, omission of a connector may be detected.

In order to achieve the object, according to an aspect of the present invention, there is provided a conveying device including: a jam detection device; a processing unit that processes cut sheets while conveying the cut sheets; a first conveying unit that transfers the cut sheets to the processing unit; and a second conveying unit that receives the cut sheets from the processing unit. The jam detection device includes: a synchronization signal generation unit that generates a conveying synchronization signal for synchronization with a conveying operation of a conveying device including a processing unit configured to process cut sheets while conveying the cut sheets, a first conveying unit configured to transfer the cut sheets to the processing unit, and a second conveying unit configured to receive the cut sheets from the processing unit; a first detection sensor that is provided to face the first conveying unit and outputs a first output signal in response to passing of the cut sheets; a second detection sensor that is provided to face the second conveying unit and outputs a second output signal in response to passing of the cut sheets; a timing signal generation unit that generates a timing signal for defining detection timings of the first output signal and the second output signal; a board to which the first output signal, the second output signal, and the timing signal are input; a first wiring through which the timing signal is input to the board; a second wiring through which the conveying synchronization signal is input to the board; a conveying error detection unit that is disposed on the board and detects conveying errors of the cut sheets by detecting conditions of the first output signal and the second output signal at the detection timings; and a connection status detection unit that is disposed on the board and detects a connection status of the first wiring by comparing the conveying synchronization signal with the timing signal.

The present aspect can be applied to the conveying device having the processing unit, the first conveying unit, and the second conveying unit. In addition, there is provided a connection status detection unit. By the means, the timing signal is input to the board, which has the conveying error detection unit that detects conveying errors of the cut sheets, through the first wiring, the conveying synchronization signal is input to the board through the second wiring, and the input timing signal and the conveying synchronization signal are compared, whereby the connection status of the first wiring is detected. Therefore, it is possible to detect the wiring errors for signals for detecting the conveying errors of the sheets of paper.

It is preferable that at least one of the processing unit, the first conveying unit, and the second conveying unit is a cylinder that conveys the cut sheets by rotating while holding the cut sheets on an outer circumferential surface thereof. It is preferable that the synchronization signal generation unit includes a rotary encoder that detects a rotation angle of the cylinder. Thereby, it is possible to appropriately generate a conveying synchronization signal for synchronization with a conveying operation of a conveying device.

It is preferable that the timing signal generation unit has a disk that rotates in synchronization with rotation of the cylinder, a dog that is provided on the disk, and a sensor that detects the dog. Thereby, it is possible to appropriately define the detection timings of the first output signal and the second output signal.

The processing unit may have drying unit that heats and dries the cut sheets. The present aspect can be applied to even a case where it is difficult to directly detect occurrence of a jam in the conveying section of the processing unit since the processing unit has a high temperature.

In order to achieve the object, according to an aspect of the present invention, there is provided an image recording apparatus including: a conveying device; and an image forming unit that forms an image by ejecting ink onto cut sheets from an ink jet head while conveying the cut sheets, in which the image forming unit transfers the cut sheets, on which images are recorded by the ink jet head, to the first conveying unit. The conveying device includes: a jam detection device; a processing unit that processes the cut sheets while conveying the cut sheets; a first conveying unit that transfers the cut sheets to the processing unit; and a second conveying unit that receives the cut sheets from the processing unit. The jam detection device includes: a synchronization signal generation unit that generates a conveying synchronization signal for synchronization with a conveying operation of a conveying device including a processing unit configured to process cut sheets while conveying the cut sheets, a first conveying unit configured to transfer the cut sheets to the processing unit, and a second conveying unit configured to receive the cut sheets from the processing unit; a first detection sensor that is provided to face the first conveying unit and outputs a first output signal in response to passing of the cut sheets; a second detection sensor that is provided to face the second conveying unit and outputs a second output signal in response to passing of the cut sheets; a timing signal generation unit that generates a timing signal for defining detection timings of the first output signal and the second output signal; a board to which the first output signal, the second output signal, and the timing signal are input; a first wiring through which the timing signal is input to the board; a second wiring through which the conveying synchronization signal is input to the board; a conveying error detection unit that is disposed on the board and detects conveying errors of the cut sheets by detecting conditions of the first output signal and the second output signal at the detection timings; and a connection status detection unit that is disposed on the board and detects a connection status of the first wiring by comparing the conveying synchronization signal with the timing signal.

The present aspect can be applied to the image recording apparatus that records images on the cut sheets. In addition, there is provided a connection status detection unit. By the means, the timing signal is input to the board, which has the conveying error detection unit for detecting conveying errors of the cut sheets, through the first wiring, the conveying synchronization signal is input to the board through the second wiring, and the input timing signal and the conveying synchronization signal are compared, whereby the connection status of the first wiring is detected. Therefore, it is possible to detect the wiring errors for signals for detecting the conveying errors of the sheets of paper.

In order to achieve the object, according to an aspect of the present invention, there is provided a connection status detection method including steps of: generating a conveying synchronization signal for synchronization with a conveying operation of a conveying device, and inputting the conveying synchronization signal to aboard through a second wiring, the conveying device including a processing unit configured to process cut sheets while conveying the cut sheets, a first conveying unit configured to transfer the cut sheets to the processing unit, and a second conveying unit configured to receive the cut sheets from the processing unit; inputting a first output signal to the board in response to passing of the cut sheets by a first detection sensor that is provided to face the first conveying unit; inputting a second output signal to the board in response to passing of the cut sheets by a second detection sensor that is provided to face the second conveying unit; generating a tuning signal for defining detection timings of the first detection sensor and the second detection sensor, and inputting the timing signal to the board through a first wiring; detecting conveying errors of the cut sheets by detecting conditions of the first output signal and the second output signal, which are input to the board, at the detection timings; and detecting a connection status of the first wiring by comparing the conveying synchronization signal and the timing signal which are input to the board.

According to the present aspect, the conveying errors of the cut sheets are detected by detecting conditions of the first output signal and the second output signal, which are input to the board, at the detection timings, and the connection status of the first wiring is detected by comparing the conveying synchronization signal, which is input through the second wiring, and the timing signal which is input through the first wiring. Therefore, it is possible to detect the wiring errors for signals for detecting the conveying errors of the sheets of paper.

According to the present invention, by detecting the wiring errors of the signals for detecting the conveying errors of the sheets of paper, the conveying errors of the sheets of paper are reliably detected. Thus, it is possible to prevent sheets of paper from remaining in the apparatus.

DESCRIPTION OF THE PREFERRED EMBODIMENTS

Hereinafter, preferred embodiments of the present invention will be described in detail with reference to the accompanying drawings.

First Embodiment

Figure 1:
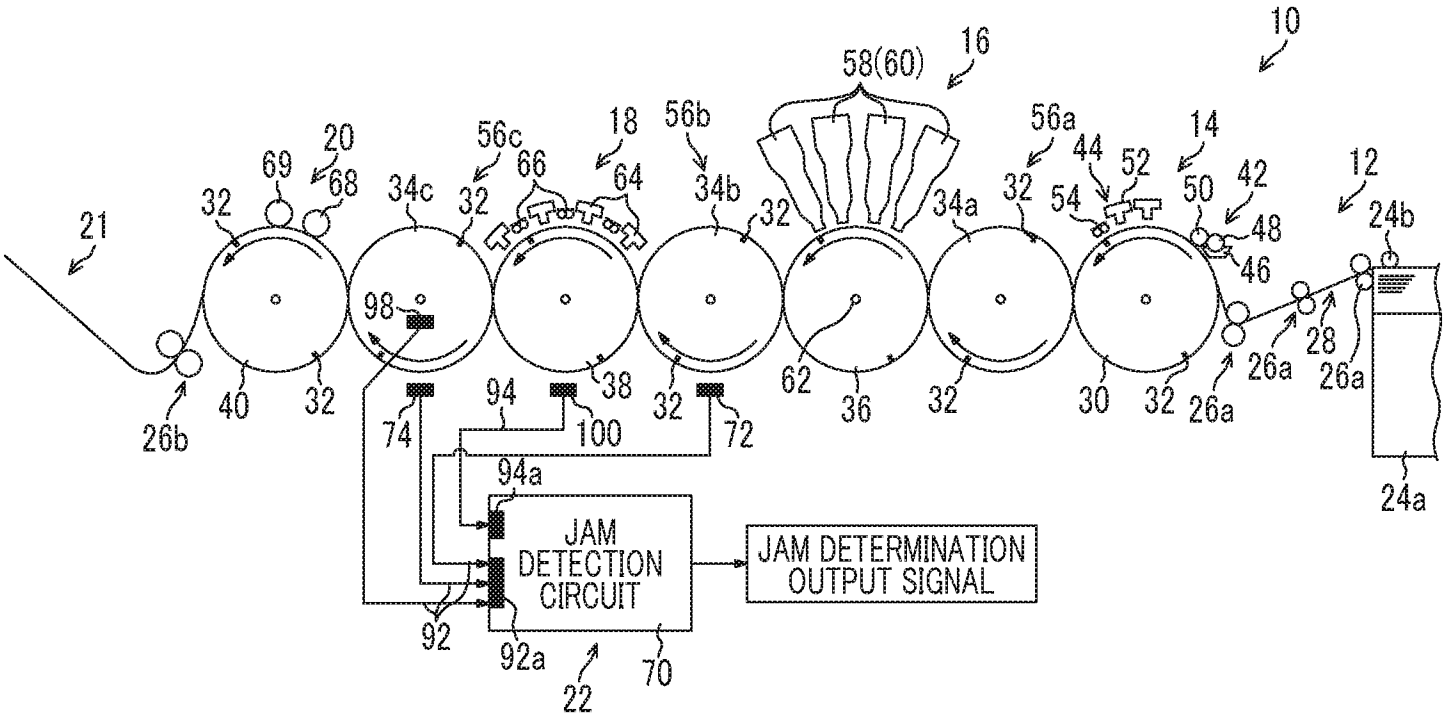
FIG. 1 is a schematic configuration diagram illustrating an apparatus configuration of an example of an ink jet recording apparatus.
Figure 2:
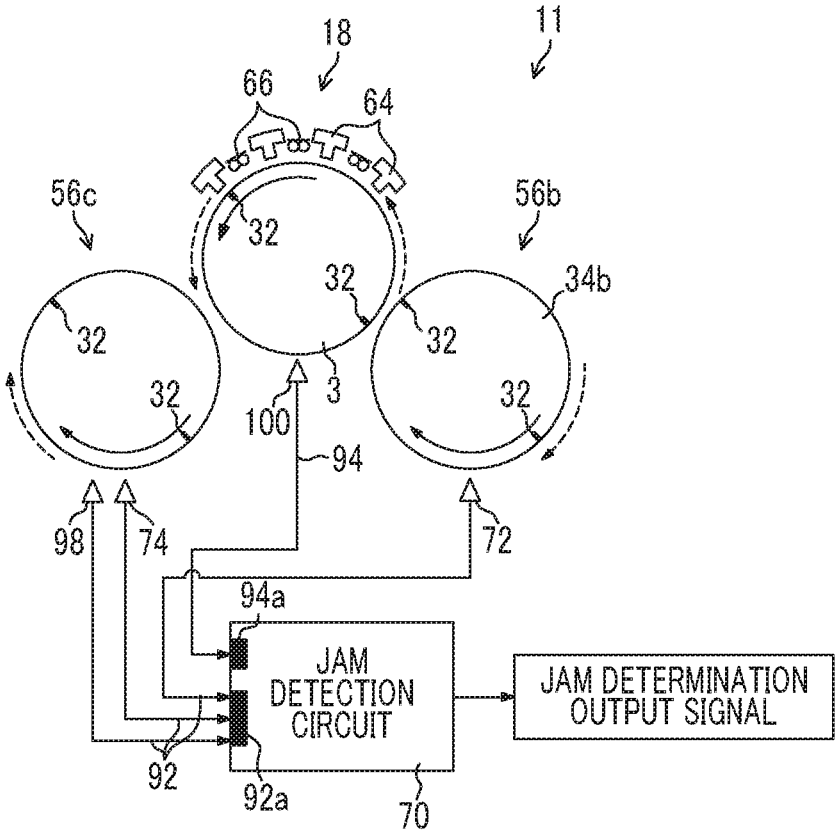
FIG. 2 is a schematic configuration diagram of principal sections of the ink jet recording apparatus.

FIG. 1 is a schematic configuration diagram illustrating an apparatus configuration of an example of an ink jet recording apparatus according to the present embodiment. FIG. 2 is a schematic configuration diagram of principal sections of the ink jet recording apparatus shown in FIG. 1.

As shown in FIG. 1, an ink jet recording apparatus 10 (an example of the image recording apparatus) includes a sheet feeding conveying section 12 that feeds cut sheets (sheets of paper) as recording media; a processing liquid coating section 14 that coats recording surfaces of the sheets of paper with a processing liquid; an image forming section 16 that forms images on the recording surfaces of the sheets of paper; an ink drying section 18 that dries images formed on the recording surfaces; an image fixing section 20 that fixes the dried images onto the sheets of paper; a discharging section 21 that discharges the sheets of paper onto which images are fixed; and a jam detection section 22.

(Sheet Feeding Conveying Section)

The sheet feeding conveying section 12 is provided with a stacking section 24*a* on which the sheets of paper are stacked, and is provided with a sheet feeding section 24*b* that feeds the sheets of paper, which are stacked on the stacking section 24*a*, one by one in a sheet conveying direction downstream side (hereinafter simply referred to as a downstream side) of the stacking section 24*a*. The sheet feeding section 24*b* conveys the fed sheets of paper to the processing liquid coating section 14 through a conveying section 28 that is formed of a plurality of pairs of conveying rollers 26*a*.

(Processing Liquid Coating Section)

In the processing liquid coating section 14, a processing liquid coating drum (cylinder) 30 is rotatably disposed. The processing liquid coating drum 30 is disposed between an intermediate conveying drum 34*a* of an intermediate conveying section 56*a* and pairs of conveying rollers 26*a* on the most downstream side of the sheet feeding conveying section 12 on the upstream side. The processing liquid coating drum 30 is provided with chucks 32 as chucking members for chucking leading end sections of sheets of paper, receives the sheets of paper from the pairs of conveying rollers 26*a* of the sheet feeding conveying section 12 on the upstream side, and transfers the sheets of paper to the intermediate conveying drum 34*a* of the intermediate conveying section 56*a* on the downstream side, by rotation of the processing liquid coating drum 30 in a state where the sheets of paper are held on the outer circumferential surface (outer surface) of the processing liquid coating drum 30 by chucking the leading end sections of the sheets of paper with the chucks 32. Thereby, sheets of paper are conveyed from the sheet feeding conveying section 12 on the upstream side to the intermediate conveying section 56*a* on the downstream side. In the embodiment of the example shown in the drawing, the two chucks 32 are provided at positions which are symmetric to each other in close proximity to the outer surface of the processing liquid coating drum 30, and the processing liquid coating drum 30 is configured to hold two sheets of paper on the outer surface.

In addition, in a manner similar to that of the processing liquid coating drum 30, two chucks 32 are also provided on each of intermediate conveying drums 34*a*, 34*b*, and 34*c*, and an image forming drum 36, an ink drying drum 38, and an image fixing drum 40 as processing cylinders to be described later. Then, by using the chucks 32, the sheets of paper are transferred from the upstream side drum to the downstream side drum.

A processing liquid coating device 42 and a processing liquid drying device 44 are disposed along a circumferential direction of the processing liquid coating drum 30 above the processing liquid coating drum 30. While the processing liquid coating drum 30 is rotated in a state where the sheets of paper are held on the outer surface, the processing liquid coating device 42 coats the recording surfaces of the sheets of paper with a processing liquid, and the processing liquid drying device 44 dries the processing liquid.

Here, the processing liquid has an effect that aggregates color materials (pigments) in reaction to an ink for forming an image and promotes separation between the color materials and a solvent. The processing liquid coating device 42 is provided with a storage section 46 that stores the processing liquid, and a part of a gravure roller 48 dips into the processing liquid.

A rubber roller 50 is disposed to be pressed in contact with the gravure roller 48. The rubber roller 50 is in contact with the recording surfaces (surface) of the sheets of paper, and coats the surfaces with the processing liquid. Further, the gravure roller 48 is in contact with a squeegee (not shown in the drawing) so as to control an amount of the processing liquid with which the recording surfaces of the sheets of paper are coated.

On the other hand, in the processing liquid drying device 44, a hot-air nozzle 52 and an infrared heater (hereinafter referred to as an IR heater) 54 are disposed near the surface of the processing liquid coating drum 30. The hot-air nozzle 52 and the IR heater 54 evaporate solvents, such as water, in the processing liquid, and a thin solid layer or a thin film processing liquid layer are formed on the recording surfaces of the sheets of paper. The processing liquid is formed as a thin film in a processing liquid drying process, liquid droplet dots, which are ejected by the image forming section 16, and comes into contact with the surfaces of the sheets of paper, whereby it is possible to obtain a desired dot diameter. In addition, color materials are aggregated in reaction to the processing liquid formed as a thin film, whereby it is possible to easily obtain an effect to fix the liquid droplet dots onto the sheets of paper surface.

As described above, the processing liquid coating section 14 coats the recording surfaces with the processing liquid, and the dried sheets of paper are conveyed to the intermediate conveying section 56*a* which is provided between the processing liquid coating section 14 and the image forming section 16.

(Intermediate Conveying Section)

The intermediate conveying drum 34*a*, which corresponds to a delivery cylinder, is rotatably provided in the intermediate conveying section 56*a*. The intermediate conveying drum 34*a* is disposed between the processing liquid coating drum 30 of the processing liquid coating section 14 and the image forming drum 36 of the image forming section 16, and is provided with chucks 32. The intermediate conveying drum 34*a* receives sheets of paper from the processing liquid coating drum 30 on the upstream side, holds the sheets of paper on the outer surface of the intermediate conveying drum 34*a* by chucking the leading ends of the sheets of paper with the chucks 32, and transfers the sheets of paper to the image forming drum 36 on the downstream side by rotation of the intermediate conveying drum 34*a*. Thereby, the sheets of paper are conveyed from the processing liquid coating section 14 on the upstream side to the image forming section 16 on the downstream side.

In addition, a configuration, which is the same as that of the intermediate conveying section 56*a*, is applied to the intermediate conveying section 56*b*, which is provided between the image forming section 16 and the ink drying section 18, and the intermediate conveying section 56*c* which is provided between the ink drying section 18 and the image fixing section 20. Therefore, a detailed description thereof will be omitted.

(Image Forming Section)

The image forming drum 36 is rotatably provided in the image forming section 16 (an example of the image forming unit). The image forming drum 36 is disposed between the intermediate conveying drum 34*a* and the intermediate conveying drum 34*b*. The image forming drum 36 is provided with chucks 32. The image forming drum 36 receives the sheets of paper from the intermediate conveying drum 34*a* on the upstream side, holds the sheets of paper on the outer circumferential surface of the image forming drum 36 by chucking the leading ends of the sheets of paper with the chucks 32, and transfers the sheets of paper to the intermediate conveying drum 34*b* on the downstream side by rotation of the image forming drum 36. Thereby, the sheets of paper are conveyed from the intermediate conveying section 56*a* on the upstream side to the intermediate conveying section 56*b* on the downstream side.

A head unit 60 formed of four ink jet heads 58 is disposed in close proximity to the surface of the image forming drum 36, above the image forming drum 36. In the head unit 60, the ink jet heads 58 for at least four colors of YMCK (yellow, magenta, cyan, and black) as primary colors are arranged along the outer circumferential direction of the image forming drum 36. Each ink jet head 58 of the head unit 60 for each color forms an image of each color by ejecting ink (liquid droplets) from nozzles onto processing liquid layers, which are formed on the recording surfaces of the sheets of paper by the processing liquid coating section 14, while the image forming drum 36 is rotated in a state where sheets of paper are held on the outer surface thereof.

The processing liquid has an effect that aggregates latex particles and color materials dispersing in the ink, and forms aggregates which prevent color materials from flowing on the sheets of paper. An example of reaction between the ink and the processing liquid is as follows. The processing liquid contains acid, and thus destroys pigment dispersion by decreasing a PH (hydrogen-ion exponent), and the color materials permeates into the sheets by using a mechanism of the aggregation. Thereby, respective color inks are prevented from mixing, with each other, and ejection interference due to coalescence of liquid droplets at the time of landing of ink droplets is avoided.

The ink jet head 58 ejects liquid droplets of the ink in synchronization with an encoder (not shown in the drawing) that is disposed on the image forming drum 36 so as to detect a rotational speed thereof, thereby determining a landing position of the droplets at high accuracy and being able to reduce unevenness in ejection, regardless of waggling of the image forming drum 36, the accuracy of the rotational shaft 62, and the speed of the drum surface.

It should be noted that the head unit 60 is retractable from the upper side of the image forming drum 36. Accordingly, maintenance operations such as discharge of thickened ink and cleaning of nozzle surfaces of the ink jet heads 58 are performed by retracting the head unit 60 from the upper side of the image forming drum 36. In the image forming section 16, the sheets of paper, of which the recording surfaces have the images formed thereon, are conveyed to the ink drying section 18 through the intermediate conveying section 56*b* which is provided between the image forming section 16 and the ink drying section 18, by rotation of the image forming drum 36.

(Intermediate Conveying Section)

The intermediate conveying drum 34*b* is rotatably provided in the intermediate conveying section 56*b*. Likewise, the intermediate conveying drum 34*b* is provided with chucks 32. The intermediate conveying drum 34*b* is disposed between the image forming drum 36 and the ink drying drum 38. The intermediate conveying drum 34*b* receives the sheets of paper from the image forming drum 36 on the upstream side, holds the sheets of paper on the outer circumferential surface of the intermediate conveying drum 34*b* by chucking the leading ends of the sheets of paper with the chucks 32, and transfers the sheets of paper to the ink drying drum 38 on the downstream side by rotation of the intermediate conveying drum 34*b*. Thereby, the sheets of paper are conveyed from the image forming section 16 on the upstream side to the ink drying section 18 on the downstream side.

(Ink Drying Section)

In the ink drying section 18. The ink drying drum 38 is rotatably provided between the intermediate conveying drum 34*b* of the intermediate conveying section 56*b* and the intermediate conveying drum 34*c* of the intermediate conveying section 56*c*. A plurality of hot-air nozzles 64 and a plurality of IR heaters 66 are arranged in close proximity to the surface the surface of the ink drying section, above the ink drying drum 38.

The ink drying drum 38 is provided with chucks 32. The ink drying drum 38 receives the sheets of paper from the intermediate conveying drum 34*b* on the upstream side, holds the sheets of paper on the outer circumferential surface of the ink drying drum 38 by chucking the leading ends of the sheets of paper with the chucks 32, and transfers the sheets of paper to the intermediate conveying drum 34*c* on the downstream side by rotation of the ink drying drum 38. Thereby, the sheets of paper are conveyed from the intermediate conveying section 56*b* on the upstream side to the intermediate conveying section 56*c* on the downstream side (an example of the conveying operation).

In the present embodiment, for example, the hot-air nozzles 64 (an example of the drying unit) are arranged on the upstream side and the downstream side, and the IR heaters 66 (an example of the drying unit), each one of which is arranged in parallel with each of the hot-air nozzles 64, are alternately arranged, thereby heating and drying the sheets of paper. The configuration of the drying unit is not limited to this. For example, many more IR heaters 66 may be arranged on the upstream side so as to increase a temperature of moisture by irradiating the sheets with much more heat energy on the upstream side. In addition, many more hot-air nozzles 64 may be arranged on the downstream side so as to blow the saturated water vapor off.

The ink drying section 18 dries solvents separated due to the color material aggregation effect, in the image formation regions of the sheets of paper, by hot air formed through the hot-air nozzles 64 and the IR heaters 66, while the ink drying drum 38 is rotated in a state where the sheets of paper are held on the outer surface thereof. Thereby, a thin image layer is formed on each sheet.

In the ink drying section 18, the sheets of paper, of which the recording surfaces have the images dried thereon, are conveyed to the image fixing section 20 through the intermediate conveying section 56*c* which is provided between the ink drying section 18 and the image fixing section 20, by rotation of the ink drying drum 38.

(Intermediate Conveying Section)

The intermediate conveying drum 34*c* is rotatably provided in the intermediate conveying section 56*c*. Likewise, the intermediate conveying drum 34*c* is provided with chucks 32. The intermediate conveying drum 34*c* is disposed between the ink drying drum 38 and the image fixing drum 40. The intermediate conveying drum 34*c* receives the sheets of paper from the ink drying drum 38 on the upstream side, holds the sheets of paper on the outer circumferential surface of the intermediate conveying drum 34*c* by chucking the leading ends of the sheets of paper with the chucks 32, and transfers the sheets of paper to the image fixing drum 40 on the downstream side by rotation of the intermediate conveying drum 34*c*. Thereby, the sheets of paper are conveyed from the ink drying section 18 on the upstream side to the image fixing section 20 on the downstream side.

Here, as shown in FIG. 2, in the ink jet recording apparatus 10, there is a part referred to as a sheet conveying device 11 (an example of a sheet conveying device). The part includes the intermediate conveying section 56*b* (an example of the first conveying unit), the ink drying section 18 (an example of the processing unit), and the intermediate conveying section 56*c* (an example of the second conveying unit).

(Image Fixing Section)

The image fixing drum 40 is rotatably provided in the image fixing section 20. The image fixing drum 40 is disposed between the intermediate conveying drum 34*c* and a pair of conveying rollers 26*h* of the discharging section 21. The image fixing drum 40 is provided with chucks 32. The image fixing drum 40 receives the sheets of paper from the intermediate conveying drum 34*c* on the upstream side, holds the sheets of paper on the outer circumferential surface of the image fixing drum 40 by chucking the leading ends of the sheets of paper with the chucks 32, and transfers the sheets of paper to the pair of conveying rollers 26*b* of the discharging section 21 on the downstream side by rotation of the image fixing drum 40. Thereby, the sheets of paper are conveyed from the intermediate conveying section 56*c* on the upstream side to the discharging section 21 on the downstream side.

The image fixing section 20 has a function of fixing the thin image layers onto the sheets of paper by heating, melting, and pressing latex particles within the thin image layers, which are formed on the ink drying drum 38, while the image fixing drum 40 is rotated in a state where the sheets of paper are held on the outer surface thereof. The heating roller 68 is disposed in close proximity to the surface of the image fixing drum 40 above the image fixing drum 40. The heating roller 68 is configured such that a halogen lamp is built in a metal pipe such as aluminum which is excellent in thermal conductivity. Thus, the heating roller 68 transfers thermal energy, which is equal to or greater than that at a glass-transition temperature Tg of latex, to the image fixing drum 40. With such a configuration, the fixing is performed by melting the latex particles and pushing the latex particles into unevenness on the sheets of paper, and unevenness of the image surface is leveled. Thereby, it is possible to obtain glossiness thereof.

In the image fixing section 20, the fixing roller 69 is provided on the downstream side of the heating roller 68. The fixing roller 69 is disposed in pressurized contact with the surface of the image fixing drum 40 so as to apply a nip pressure between the image fixing drum 40 and itself. Hence, at least one of the fixing roller 69 or the image fixing drum 40 has an elastic layer on the surface thereof, and a nip width therebetween for the sheets of paper is kept constant.

In the image fixing section 20, the sheets of paper, of which recording surfaces have images fixed thereon, are conveyed to the discharging section 21, which is provided on the downstream side of the image fixing section 20, by rotation of the image fixing drum 40.

In addition, in the present embodiment, the image fixing section 20 has been described, but the image fixing section 20 may be removed from the above configuration if the ink drying section 18 is able to dry and fix the images formed on the recording surfaces.

(Jam Detection Section)

The jam detection section 22 (an example of the jam detection device is means for detecting a jam of a sheet of paper conveyed by the sheet conveying device 11. As shown in FIG. 2, the jam detection section 22 includes a jam detection circuit 70, a first detection sensor 72, a second detection sensor 74, a timing sensor 98, a rotary encoder 100, and the like.

In the ink jet recording apparatus 10 according to the present embodiment, the ink drying drum 38 of the ink drying section 18 has a very high temperature caused by hot air blown from the hot-air nozzles 64 and heating of the IR heaters 66. Thus, it is difficult for the ink drying section 18 to directly detect occurrence of a jam. Hence, in the present embodiment, the intermediate conveying drums 34*b* and 34*c* on the upstream side and the downstream side of the ink drying drum 38 are respectively provided with the first detection sensor 72 and the second detection sensor 74 that detect passing of sheets. The first detection sensor 72 and the second detection sensor 74 monitors passing (of the leading ends and/or the tailing ends) of sheets of paper, thereby detecting whether or not a jam occurs in the ink drying section 18 or on the ink drying drum 38.

The first detection sensor 72 is disposed to face the outer surface of the intermediate conveying drum 34*b* of the intermediate conveying section 56*b* at a constant distance away from the outer surface. The first detection sensor 72 detects passing of the sheets of paper of which the leading ends owe chucked by the chucks 32 of the intermediate conveying drum 34*b*. For example, the first detection sensor 72 detects the leading ends or the tailing ends of the sheets of paper, and outputs a first sensor signal S1 (an example of the first output signal).

The second detection sensor 74 is disposed to face the outer surface of the intermediate conveying drum 34*c* of the intermediate conveying section 56*c* at a constant distance away from the outer surface. The second detection sensor 74 detects that the sheets of paper pass the sensor, that is, passing of the sheets. For example, the second detection sensor 74 detects the leading ends or the tailing ends of the sheets of paper, and outputs a second sensor signal S2 (an example of the second output signal).

In the present embodiment, as the first detection sensor 72 and the second detection sensor 74, reflection-type optical sensors are used. In the reflection-type optical sensor, the light receiving element receives, for example, light, which is emitted onto the sheets of paper by the light emitting element. A configuration of the sensors is not limited to this, and various sensors including different reflection-type sensors and transmission-type sensors may be used.

The timing sensor 98 (an example of the timing signal generation unit) is for detecting timings at which the chucks 32 has passed the first detection sensor 72 and the second detection sensor 74. In the present embodiment, photo-interrupters are disposed such that two dogs provided on a disk (not shown in the drawing) rotating in synchronization with rotation of the intermediate conveying drum 34*c* are at positions where light is blocked thereby. Thereby, the timing sensor 98 outputs a timing signal TM for an on-pulse for each half rotation (½ rotation) of the intermediate conveying drum 34*c*.

It should be noted that the positions where the dogs are provided may be adjusted such that the timing signal is output at a position where the sensor condition has to be monitored. Further, the timing sensor 98 may be provided on the intermediate conveying drum 34*b*.

The first sensor signal S1, the second sensor signal S2, and the timing signal TM are input to a, first wire harness 92, and are input to the jam detection circuit 70 through a first connector section 92*a* (an example of the first wiring).

The rotary encoder 100 (an example of the synchronization signal generation unit) is provided on the ink drying drum 38 (an example of a cylinder), and outputs a signal corresponding to a rotation angle of the ink drying drum 38. A cylinder rotation detection signal R_ENC_Z an example of the conveying synchronization signal for synchronization with the conveying operation), which is output herein, is a Z-phase signal of the rotary encoder 100, is an off-pulse which is output once for each rotation of the ink drying drum 38. This cylinder rotation detection signal R_ENC_Z is input to a second wire harness 94, and is input to the jam detection circuit 70 through a second connector section 94*a* (an example of the second wiring).

The jam detection circuit 70 (an example of the conveying error detection unit) detects a jam from the input first sensor signal S1 and the second sensor signal S2, for example, conveying errors of sheets of paper such as a paper jam, and outputs a jam determination output signal. It should be noted that any jam detection method may be used if the jam detection circuit 70 is able to detect a jam by using the first sensor signal S1 and the second sensor signal S2.

In the present embodiment, both the first detection sensor 72 and the second detection sensor 74 are provided before and after on the upstream side and the downstream side of the ink drying drum 38 of the intermediate conveying drums 34*b* and 34*c*. However, a configuration of the sensors is not limited to this, and the sensors may be respectively provided on two intermediate conveying drums before and after the processing cylinder that performs any process on the sheets of paper. For example, sensors may be respectively provided on the two intermediate conveying drums 34*a* and 34*b* before and after the image forming drum 36 so as to detect whether or not a jam occurs in the image forming section 16 or the image forming drum 36.

Further, one of the two detection sensors may be provided on only one intermediate conveying drum on one side before or after the processing cylinder, and the other detection sensor may be provided in the conveying path of sheets of paper, on the other side of the processing cylinder. For example, in a case of the processing liquid coating drum 30 of the processing liquid coating section 14, the intermediate conveying drum is not present on the upstream side. Thus, the second detection sensor 74 may be provided on the intermediate conveying drum 34*a* on the downstream side, and the first detection sensor 72 may be provided on one roller of the pairs of conveying rollers 26*a* of the conveying section 28 on the upstream side. In addition, in a case of the image fixing drum 40 of the image fixing section 20, the intermediate conveying drum is not present on the downstream side. Thus, the first detection sensor 72 may be provided on the intermediate conveying drum 34*c* on the upstream side, and the second detection sensor 74 may be provided on one roller of the pairs of conveying rollers 26*b* of the discharging section 21 on the downstream side.

Furthermore, if accuracy of detection as to whether or not a jam occurs decreases but the accuracy of detection is within an allowable range, one of the two detection sensors may be provided on only one intermediate conveying drum on one side immediately before or immediately after the processing cylinder, and the other detection sensor may be provided in the conveying path or on the intermediate conveying drum at a far distance on the other side of the processing cylinder.

(Operation of Jam Detection Circuit)

Figure 3:
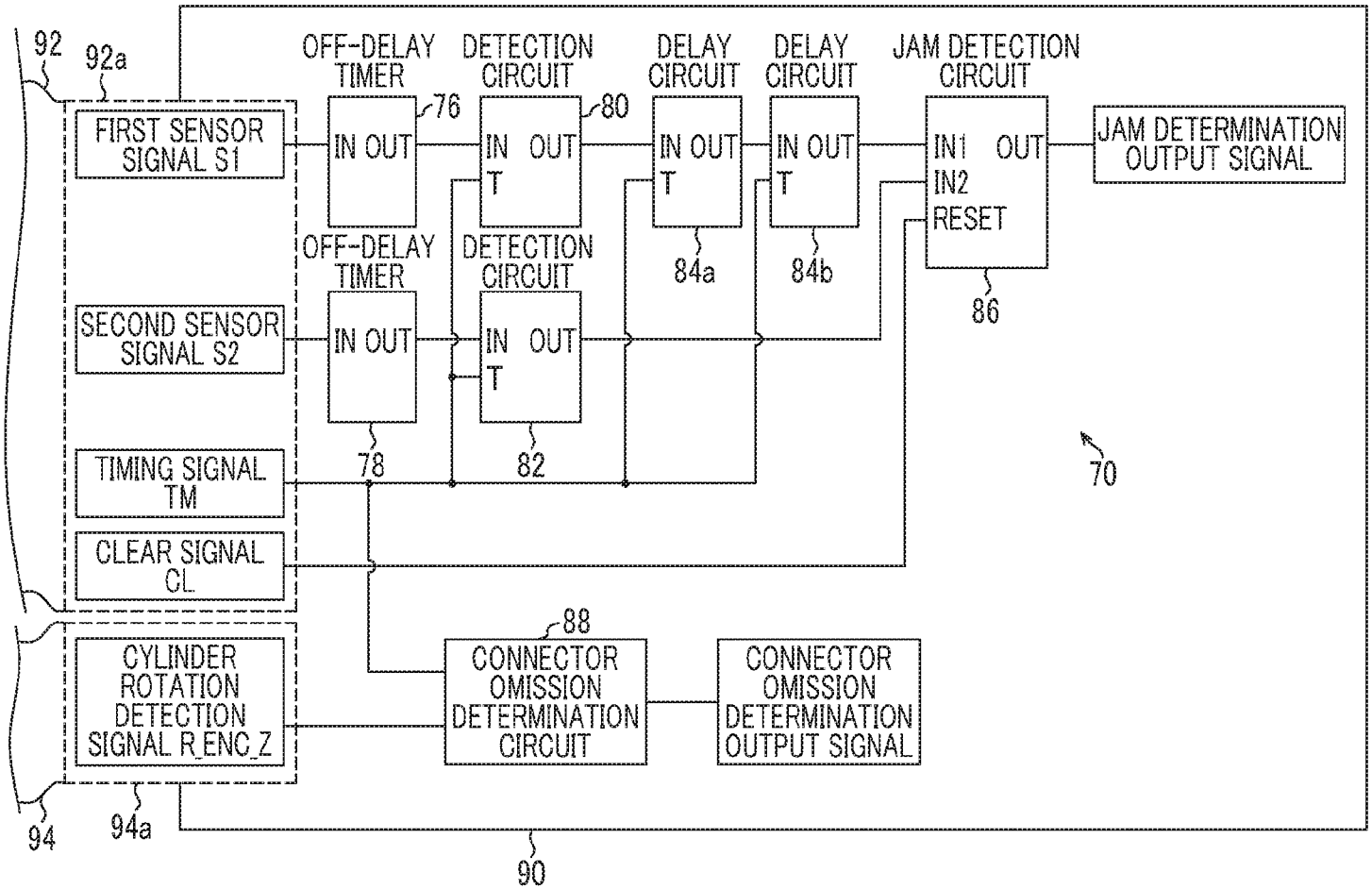
FIG. 3 is a block diagram of one example of a jam detection circuit of the ink jet recording apparatus.

Next, the jam detection circuit of the present embodiment will be described in detail. FIG. 3 is a block diagram of one example of a circuit configuration of the jam detection circuit 70 shown in FIG. 2. As shown in the drawing, the jam detection circuit 70 has a first off-delay timer 76, a second off-delay timer 78, a first detection circuit 80, a second detection circuit 82, a first stage delay circuit 84*a*, a second stage delay circuit 84*b*, a jam determination circuit 86, a connector omission determination circuit 88, and the like.

The jam detection circuit 70 is mounted on a board 90. The board 90 is connected to the first wire harness 92 through the first connector section 92*a*, and is connected to the second wire harness 94 through the second connector section 94*a*.

Not only the first sensor signal S1, the second sensor signal 82, and the timing signal TM mentioned above hut also a clear signal CL to be described later is input from the first wire harness 92. Further, the cylinder rotation detection signal R_ENC_Z is input from the second wire harness 94.

The first off-delay timer 76 delays a timing of OFF (L level) as a logic opposite to that of the first sensor signal S1, of which a detection logic is ON (H level), by a timer setting time period. The first off-delay timer 76 outputs the first sensor signal subjected to signal processing for canceling change in signal shorter than the timer setting time period of the first sensor signal S1, that is, change in an OFF state.

The second off-delay timer 78 delays a timing of OFF as a logic opposite to that of the second sensor signal S2, of which a detection logic is ON, by a tinier setting time period. The second off-delay timer 78 outputs the second sensor signal subjected to signal processing for canceling change in signal shorter than the timer setting time period of the second sensor signal S2, that is, change in an OFF state.

The first detection circuit 80 detects a state of the first sensor signal on which signal processing is performed by the first off-delay timer 76 in the detection timing (sensor check timing) of the input timing signal TM, acquires the state as a first detection signal DS1, and outputs the signal. Here, the first detection circuit 80 outputs a pulse signal (an on-pulse or a flag), which indicates detection of sheets of paper, as the first detection signal DS1 if the logic of the input first sensor signal is ON, and the first detection signal DS1 remains in a non-sheet-detection (OFF) state if the logic of the first sensor signal is OFF.

The second detection circuit 82 detects a state of the second sensor signal on which signal processing is performed by the second off-delay timer 78 in the detection timing (sensor check timing) of the input timing signal TM, acquires the state as a second detection signal DS2, and outputs the signal. Here, the second detection circuit 82 outputs a pulse signal (an on-pulse or a flag), which indicates detection of sheets of paper, as the second detection signal DS2 if the logic of the input second sensor signal is ON, and the second detection signal DS2 remains in a non-sheet-detection state if the logic of the second sensor signal is OFF.

As described above, the timing signal TM defines timings (detection timings) of detecting the logics of the first sensor signal and the second sensor signal.

The first stage delay circuit 84*a* and the second stage delay circuit 84*b* correct deviation between the detection timing of the first detection signal DS1 and the detection timing of the second detection signal DS2, thereby delaying a pulse signal of the first detection signal DS1 by an amount of the deviation between the detection timings. In the present embodiment, the deviation between the detection timings corresponds to an amount of two detection timings, that is, two stages, and each of the first stage delay circuit 84*a* and the second stage delay circuit 84*b* delays a pulse signal of the first detection signal DS1 by an amount of a single detection timing at a time. Thereby, a first delayed detection signal DD1, which is obtained by delaying the pulse signal of the first detection signal DS1 by two stages, is output.

Here, for example, an FF (flip-flop) and the like are used as the first stage delay circuit 84*a* and the second stage delay circuit 84*b*, and those are configured as shift registers. With such a configuration, delays having a required number of stages are performed. That is, the timing signal TM is input to the first stage delay circuit 84*a* and the second stage delay circuit 84*b*, and for each of the circuits, the first detection signal DS1 is delayed by one stage at a time whenever the detection timing pulse (check pulse) comes. In such a manner, the first delayed detection signal DD1, which is obtained by delaying the pulse signal of the first detection signal DS1 by two stages, is output from the second stage delay circuit 84*b* at the subsequent stage.

In the present embodiment, in the case where the deviation between the detection timings corresponds to the amount of the two detection timings, the delay circuits are connected in two stages. However, the number of deviations may be once and may be equal to or greater than three times, in accordance with the position where the first detection sensor 72 and the second detection sensor 74 are provided. Therefore, it is preferable that the number of stages of the delay circuits is set in accordance with the number of deviations. Further, delays having a required number of stages may be performed using a single delay circuit.

The jam determination circuit 86 detects matching/mismatching between the pulse signal of the first detection signal DS1, which is output from the second stage delay circuit 84*b* and is delayed in two stages, and the pulse signal of the second detection signal DS2 which is output from the second detection sensor 74. In a case of mismatching, it is determined that a sheet of paper jammed, and the jam determination output signal is output from the pulse signal (the on-pulse or the flag). In a case of matching, it is determined that passing of sheets is normal, and the jam determination output signal in the OFF state is output. It should be noted that the clear signal CL is for resetting the determination in the jam determination circuit 86.

The connector omission determination circuit 88 (an example of the connection status detection unit) is for detecting wiring errors by comparing the input timing signal TM and with the cylinder rotation detection signal R_ENC_Z. The wiring errors includes: omission (missing) of the first connector section 92*a* and the second connector section 94*a*; disconnection of the first wire harness 92 and the second wire harness 94; missing of the first wire harness 92, the first connector section 92*a* of the second wire harness 94, and a connector section (not shown in the drawing) which is on a side opposite to the second connector section 94*a*, or the like.

In the present embodiment, the jam detection circuit 70 is configured as described above, but each component may be separately configured, and may be configured as an FPGA (Field programmable gate array).

Further, the first off-delay timer 76 and the second off-delay timer 78 may be configured to be omitted by using off-delay timers as the first detection sensor 72 and the second detection sensor 74, on-delay timers opposite thereto, and the like.

Next, the jam detection method of the jam detection circuit 70 of the present embodiment will be described. However, for convenience of description, first, the description will be given on the basis of timing charts shown in FIGS. 4A to 4I in a case where timer setting time periods of the first off-delay timer 76 and the second off-delay timer 78 shown in FIG. 3 are 0. It should be noted that the case where the timer setting time periods are 0 corresponds to a case where the first off-delay timer 76 and the second off-delay timer 78 are not provided in the jam detection circuit 70 shown in FIG. 3.

Figure 4:
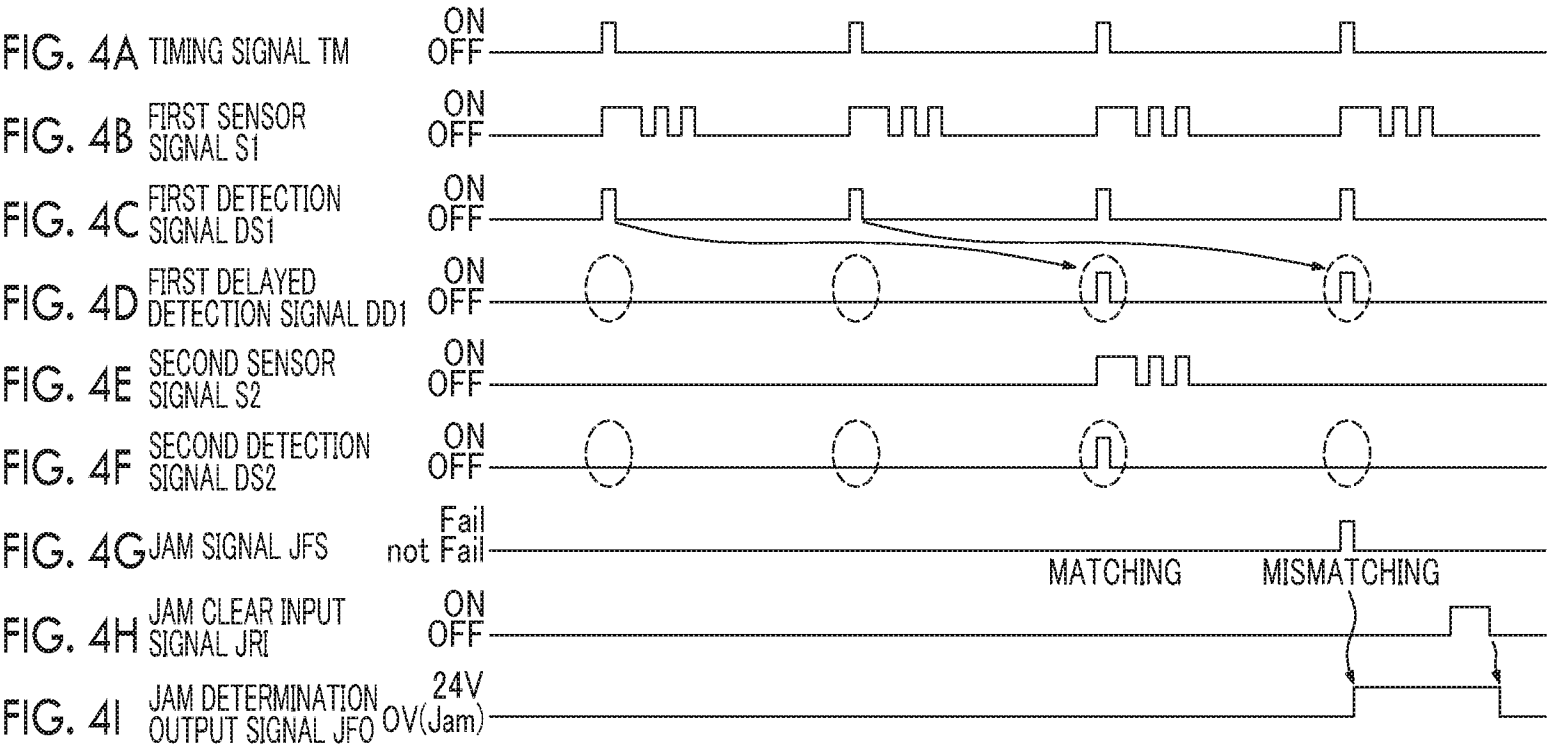
FIGS. 4A to 4I are timing charts of examples of signals of respective sections of the jam detection circuit.

The timing signal TM shown in FIG. 4A is an output of the timing sensor 98, and indicates that the check pulse indicating the sensor check timing, that is, the detection timing of passing of sheets is output four times. The timing signal TM is for determining whether or not the sheets of paper are detected by the first detection sensor 72 and the second detection sensor 74 at a timing of response of the timing sensor and determining whether a jam occurs during the above determination. Here, the reason for this is that there is the following disadvantage. If erroneous sensor detection is caused by the first detection sensor 72 and the second detection sensor 74, even though passing state is normal, erroneous jam determination may occur.

The first sensor signal S1, which is output from the first detection sensor 72 shown in FIG. 4B, is a pulse signal which indicates that the first detection sensor 72 detects the chucks 32 and the sheets of paper of which the leading ends are chucked by the chucks 32 and which has the detection logic of ON. In the latter part, the first sensor signal S1 indicates change in signal in a short interval. The change is caused by flutters of the tailing ends of the sheets of paper. The first sensor signal S1 includes change in signal in the short interval, but indicates that the sheets of paper are appropriately detected four times, in a manner similar to that of the timing signal TM shown in FIG. 4A. Further, in the example shown in the drawing, change in signal in the short interval in the latter part deviates from the timing of the check pulse of the timing signal TM. Therefore, the change has no effect on pulse generation of the first detection signal DS1 in the subsequent first detection circuit 80.

The first detection signal DS1 shown in FIG. 4C is a signal which is output from the first detection circuit 80, and indicates that the on-pulse indicating an ON state of the first sensor signal S1 is output at the timing of the check pulse of the timing signal TM which is input to the first detection circuit 80 and is shown in FIG. 4A. In the example shown in the drawing, the first detection signal DS1 indicates that four on-pulses are output to respectively correspond to the four check pulses of the timing signal TM.

The first delayed detection signal DD1 shown in FIG. 4D is a signal which is output from the second stage delay circuit 84*b*, and is a signal which is obtained by causing the first stage delay circuit 84*a* and the second stage delay circuit 84*b* to delay the first detection signal DS1 in two stages in accordance with the check pulses of the timing signal TM input to the circuits.

In a manner similar to that of the first sensor signal S1, the second sensor signal S2, which is output from the second detection sensor 74 shown in FIG. 4E, indicates that the second detection sensor 74 detects the chucks 32 and the sheets of paper of which the leading ends are chucked by the chucks 32. In the latter part, the second sensor signal S2 indicates change in signal in a short interval. The change is caused by flutters of the tailing ends of the sheets of paper. However, the second sensor signal S2 indicates that it delays to be slower by two stages than the first sensor signal S1. In the second sensor signal S2, a sheet-detection on-pulse corresponding to the third-stage check pulse of the timing signal TM is output, hut a sheet-detection on-pulse corresponding to the fourth-stage check pulse of the timing signal TM is not output. This means that a sheet of paper is not detected.

The second detection signal DS2 shown in FIG. 4F is a signal which is output from the second detection circuit 82, and indicates that an on-pulse indicating an ON state of the second sensor signal S2 is output at the timing of the check pulse of the input timing signal TM. In the examples shown in the drawing, the second detection signal DS2 indicates that the on-pulse corresponding to the third-stage check pulse of the timing signal TM is present but a pulse corresponding to the fourth-stage check pulse of the timing signal TM is not present.

A jam determination signal JFS shown in FIG. 4G is a signal which is generated in the jam determination circuit 86. The jam determination signal JFS is a signal as a result of determination as to whether the first delayed detection signal DD1 and the second detection signal DS2 are matched or mismatched. The first delayed detection signal DD1 is output from the second stage delay circuit 84*b* and delayed by two stages, and the second detection signal DS2 is output from the second detection circuit 82, for each of the check pulses of the timing signal TM. The jam determination signal JFS is a signal in which an on-pulse is generated since it is determined that jam occurs in a case of mismatching, and which remains in an OFF state since it is determined that passing of sheets is normal in a case of matching. In the example shown in the drawing, both the pulse signal of the first delayed detection signal DD1 and the pulse signal of the second detection signal DS2 corresponding to the third-stage check pulse of the timing signal TM are present. In addition, the jam determination signal JFS remains in the OFF state indicating that passing of sheets is normal since it is determined that the signals are matched, but a pulse signal of the first delayed detection signal DD1 corresponding to the fourth-stage check pulse of the timing signal TM is present, and a pulse signal of the second detection signal DS2 corresponding thereto is not present. Hence, the jam determination signal JFS indicates that a mismatching pulse indicating a jam is generated since it is determined that the signals are mismatched. It should be noted that the second detection signal DS2 has no pulses corresponding to the first-stage and second-stage check pulses of the timing signal TM and remains in the OFF state.

A jam clear input signal JRI shown in FIG. 4H is a pulse indicating that jam of a jammed paper or the like is cleared, and indicates an external input signal.

A jam determination output signal JFO shown in FIG. 4I is a signal which is output from the jam determination circuit 86. In the signal, a rising edge (ON) is triggered on a falling edge (OFF) of the mismatching pulse indicating a jam in the jam determination signal JFS, and a falling edge (OFF) is triggered on a falling edge (OFF) of the jam clear input signal JRI. Thus, the signal remains in an ON state indicating a jam until the jam is cleared after the jam is detected.

In the timing charts shown in FIGS. 4A to 4I, the detection logic is set as ON, and an on-pulse is used. However, the detection logic may be set as OFF, and an off-pulse may be used.

In the above description, the jam detection method of the jam detection circuit 70 according to the present embodiment is as follows. As shown in the timing charts of FIGS. 4A to 4I, the first detection signal DS1 is acquired from the input first sensor signal S1 by the first detection circuit 80 in response to the check pulses of the timing signal TM, and the first delayed detection signal DD1, which is delayed by two stages through the first stage delay circuit 84*a* and the second stage delay circuit 84*h*, is acquired from the first detection signal DS1. Meanwhile, the second detection signal DS2 is acquired from the input second sensor signal 82 by the second detection circuit 82, the first delayed detection signal DD1 and the second detection signal DS2 are compared by the jam determination circuit 86 such that the jam determination signal JFS having the pulses indicating mismatching is generated. Then, the jam determination output signal JFO based on the jam determination signal JFS is output, and is held until the jam clear input signal JRI is input from the outside.

Here, the description has been given of the case where the timer setting time periods of the first off-delay timer 76 and the second off-delay timer 78 are 0. However, by setting the timer setting time periods as appropriate values, it is possible to eliminate (cancel) the change in signal in the short interval. The change is caused due to conditions of the sheets of paper including a magnitude of a flutter depending on a thickness of a sheet of paper, a decrease in reflectance depending on a color of a surface of a sheet of paper to be detected, particularly, a surface to be detected in a case of duplex printing, and the like. As a result, it is possible to stably detect passing of sheets of paper.

That is, when a sheet of paper passes sections of the first detection sensor 72 and the second detection sensor 74, the sheet of paper flutters in accordance with the thickness of the sheet of paper. Thus, even in a case where it is difficult to stably detect passing of sheets of paper, or even in a case where it is difficult to stably detect passing of sheets of paper in accordance with the conditions of the sheets of paper when the reflection-type sensors are used as the first detection sensor 72 and the second detection sensor 74, according to the present embodiment, it is possible to stably detect passing of sheets of paper. In particular, in the first sensor signal S1 and the second sensor signal S2, if the change in signal in the short interval caused due to the conditions of the sheets of paper such as flutters of the sheets of paper is present in a range corresponding to the check pulses of the timing signal TM, passing of sheets of paper may not be stably detected. However, according to the present embodiment, even in such a case, it is possible to stably detect passing of sheets of paper. As a result, it is possible to appropriately detect a jam.

Connection Status Detection Method

First Embodiment

Figure 5:
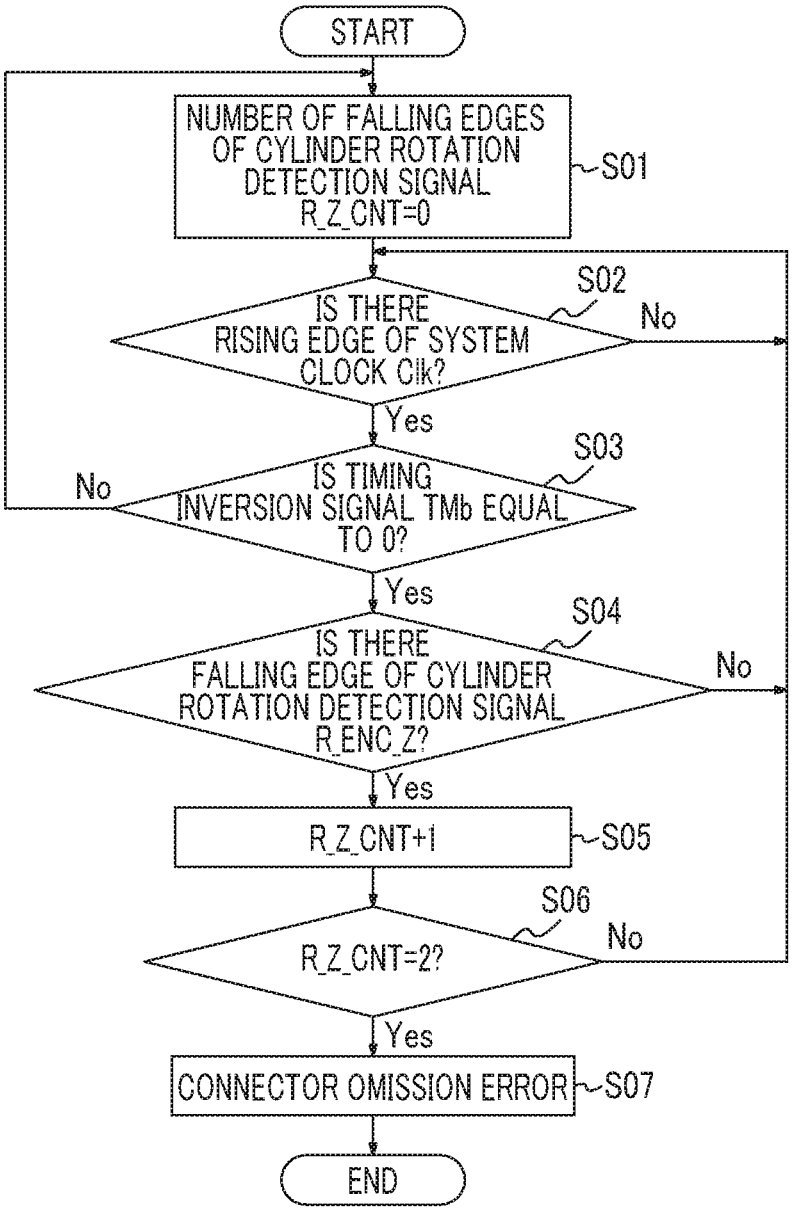
FIG. 5 is a flowchart illustrating processes of a connection status detection method.
Figure 6:
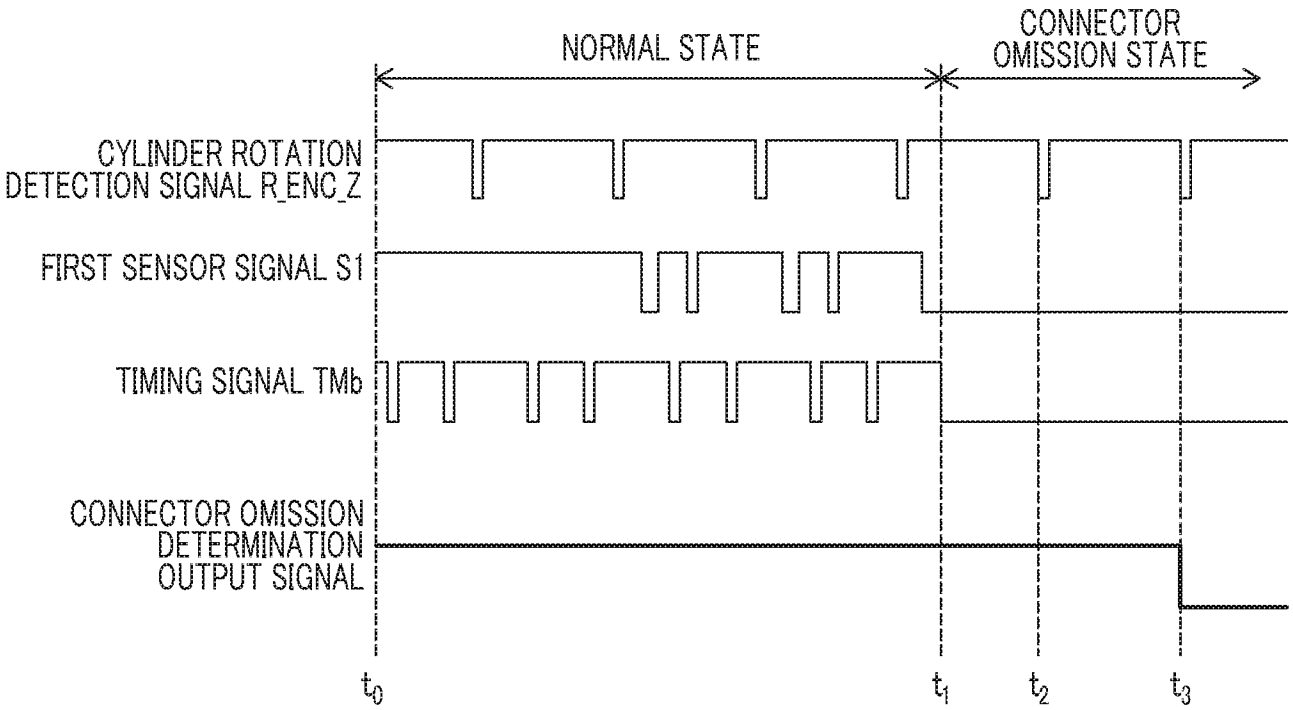
FIG. 6 is a timing chart illustrating output logics of the signals.

Next, a connection status detection method according to the present embodiment will be described. FIG. 5 is a flowchart illustrating processes of the connection status detection method. FIG. 6 is a timing chart illustrating output logics of signals. The signals include the cylinder rotation detection signal R_ENC_Z, the first sensor signal S1, an inversion signal (timing inversion signal) TMb of the timing signal, and a connector omission determination output signal which is an output signal of the connector omission determination circuit 88. Here, in a state where the ink jet recording apparatus 10 performs normal image recording, jam detection of the sheet conveying device 11 is performed, and connection statuses of the first wire harness 92 and the first connector section 92*a* are detected. Specifically, the above-mentioned state is a state where a series of the following operations is performed: the processing liquid coating section 14 coats the sheets of paper fed from the sheet feeding conveying section 12 with processing liquid, the image forming section 16 forms images, the ink drying section 18 dries the images, the image fixing section 20 fixes the dried images onto the sheets of paper, and the discharging section 21 discharges the sheets of paper onto the images are fixed.

As described above, the sheet conveying device 11 performs the jam detection of the sheets of paper by using the timing signal TM which is output periodically. Consequently, in a case where the timing signal TM is not input to the jam detection circuit 70, it is not possible to perform jam detection. Accordingly, in the present embodiment, a status of the first wire harness 92 or the first connector section 92*a*, through which the timing signal TM is input to the jam detection circuit 70, is detected in advance. Then, in a case where the connection status is abnormal, conveyance is stopped.

As shown in FIG. 6, in a case where the operation is normal (between timings $t_0$ to $t_1$), the timing signal TMb is output twice whenever the cylinder rotation detection signal R_ENC_Z is output once. That is, the intermediate conveying drum 34*c* rotates halfway for each one rotation of the ink drying drum 38.

Here, on the basis of the cylinder rotation detection signal R_ENC_Z which is input to the jam detection circuit 70 in a path different from that of the first wire harness 92 and the first connector section 92*a*, statuses of the first wire harness 92 and the first connector section 92*a* (an example of wiring) are detected.

At the beginning, the connector omission determination circuit 88 initializes a variable R_CNT, which is the number of failing edges of the cylinder rotation detection signal R_ENC_Z, to 0 (step S01). The connector omission determination circuit 88 has a counter (not shown in the drawing) for counting the number of falling edges of the cylinder rotation detection signal R_ENC_Z, and clears the counted number of the counter to 0.

Next, it is determined whether or not the rising edge of a system clock Clk is detected (step S02). The system clock Clk is not shown in the timing chart of FIG. 6, but is a square-wave signal which is generated by a pulse generation circuit not shown in the drawing) provided inside the connector omission determination circuit 88. The system clock Clk is a reference clock signal which is used in the connector omission determination circuit 88, and is used as a sampling signal of the connection status detection.

In a case where the rising edge of the system clock Clk is not detected, the current process returns to step S02. In a case where the rising edge is detected, the current process advances to step S03.

Next, it is determined whether or not the logic of the timing inversion signal TMb is OFF (L level) (step S03). The connector omission determination circuit 88 causes an internal inversion circuit (not shown in the drawing) to invert the logic of the input timing signal TM through the first wire harness 92 and the first connector section 92*a*, generates the timing inversion signal TMb, and determines the logic of the timing inversion signal TMb.

In a case where the logic of the timing inversion signal TMb is ON (H level), the current process returns to step S01, and the variable R_Z_CNT is initialized to 0. Further, in a case of OFF, the current process advances to step S04.

Next, it is determined whether or not the falling edge of the cylinder rotation detection signal R_ENC_Z is detected (step S04). As described above, in the cylinder rotation detection signal R_ENC_Z, an off-pulse is output once whenever the image forming drum 36 is changed once. As shown in the timings $t_0$ to $t_1$ of FIG. 6, the logic of the timing inversion signal TMb and the logic of the cylinder rotation detection signal Z_ENC_Z are not OFF at the same time if the connection status is normal.

In a case where the falling edge of the cylinder rotation detection signal $R_{13}$ ENC_Z is detected, the current process advances to step S05. Further, in a case where the falling edge of the cylinder rotation detection signal R_ENC_Z is not detected, that is, in a case where the logic of the timing inversion signal TMb is ON before the falling edge of the cylinder rotation detection signal R_ENC_Z, the current process advances to step S02.

In step S04, in a case where the falling edge of the cylinder rotation detection signal R_ENC_Z is detected, the connector omission determination circuit 88 adds (an increment of) 1 to the variable R_Z_CNT (step S05).

Subsequently, the connector omission determination circuit 88 determines whether or not the variable R_Z_CNT is 2, that is, whether or not the falling edge of the cylinder rotation detection signal R_ENC_Z is detected twice (an example of a plurality of detections) while the logic of the timing inversion signal TMb is OFF (step S06). In a case where the variable R_Z_CNT is not 2, the current process returns to step S02, and the same processes are repeated. Further, in a case of 2, the current process advances to step S07.

In step S06, in a case where it is determined that the variable R_Z_CNT is 2, the connector omission determination circuit 88 determines that an error (abnormality) such as disconnection of the first wire harness 92 or omission of the first connector section 92*a* occurs, and sets the logic of the connector omission determination output signal as OFF (step S07). Further, in the error state, the jam detection circuit 70 is unable to perform appropriate paper jam detection. Accordingly, in response to the OFF state of the logic of the connector omission determination output signal, the ink jet recording apparatus 10 stops conveying the sheets of paper through the conveying section 28, the processing liquid coating drum 30, the intermediate conveying drum 34*a*, the image forming drum 36, the intermediate conveying drum 34*b*, the ink drying drum 38, the intermediate conveying drum 34*c*, the image fixing drum 40, and the pair of conveying rollers 26*b*. Simultaneously, a display device or an alarm device, which is not shown in the drawing, may notify that an error occurs.

Further, the connector omission determination circuit 88 may be configured to return the logic of the connector omission determination output signal to ON in response to the clear signal CL.

In the example of FIG. 6, in the period of the timing $t_0$ to the timing $t_1$, sheets of paper are normally conveyed, and jam detection is performed. At the timing $t_1$, wiring errors of the first wire harness 92 and the first connector section 92*a* such as omission of the first connector section 92*a* occur. The connector omission determination circuit 88 is configured such that the logics of the first sensor signal S1, the second sensor signal S2, and the timing inversion signal TMb are set as OFF in a case where omission of the first connector section 92*a* occurs.

In this state, if the rising edge occurs in the system clock Clk (not shown in the drawing), the result of the determination in step S02 is Yes, and the current process advances to step S03. At this time, the logic of the timing inversion signal TMb is OFF. Thus, the result of the determination in step S03 is Yes, and the current process advances to step S04.

In step S04, the result of the determination is No until the falling edge of the cylinder rotation detection signal is detected, and the processes of steps S02 to S04 are repeated.

Thereafter, at the timing $t_2$, if the falling edge occurs in the cylinder rotation detection signal R_ENC_Z, the result of the determination is Yes in step S04, and the current process advances to step S05. In step S05, the variable R_Z_CNT is incremented, and then R_Z_CNT=1.

Since the R_Z_CNT is not 2, if the result of the determination in step S06 is No, the current process returns to step S02 again. Subsequently, if the rising edge occurs in the system clock Clk, the result of the determination in step S02 is Yes, the current process advances to step S03. Further, since the logic of the timing inversion signal TMb is OFF, the result of the determination in step S03 is Yes, and the current process advances to step S04.

In step S04, the result of the determination is No until the falling edge of the cylinder rotation detection signal R_ENC_Z is detected, the processes of steps S02 to S04 are repeated.

Thereafter, at the timing $t_3$, if the falling edge occurs in the cylinder rotation detection signal R_ENC_Z, the result of the determination is Yes in step S04. Then, the current process advances to step S05, the variable R_Z_CNT is incremented, and R_Z_CNT=2.

Since R_Z_CNT is 2, the result of the determination in step S06 is Yes. As a result, in step S07, the connector omission determination circuit 88 sets the logic of the connector omission determination output signal as OFF.

As described above, by using the signal which is input through the second wire harness 94 and the second connector section 94*a* different from the first wire harness 92 and the first connector section 92*a*, it is possible to detect the connection statuses of the first wire harness 92 and the first connector section 92*a*.

Here, in the state where the ink jet recording apparatus 10 performs normal image recording, the connection statuses are detected. However, at the starting (when power is turned on of the apparatus and the like, conveying of sheets of paper may not be performed. In this case, only connection status detection may be performed without jam detection.

Connection Status Detection Method

Second Embodiment

In the first embodiment, the connection statuses of the first wire harness 92 and the first connector section 92*a* are detected. However, in the present embodiment, the statuses of the second wire harness 94 and the second connector section 94*a* are detected.

Figure 7:
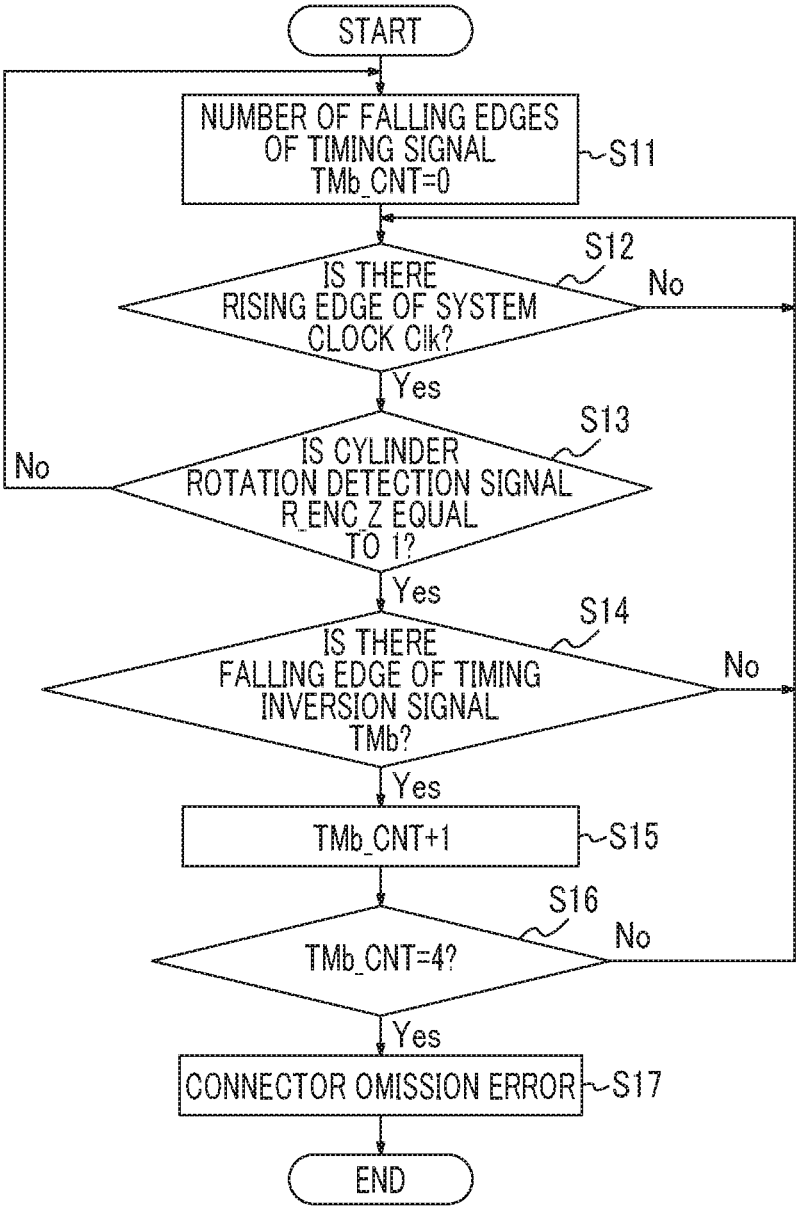
FIG. 7 is a flowchart illustrating processes of a connection status detection method.
Figure 8:
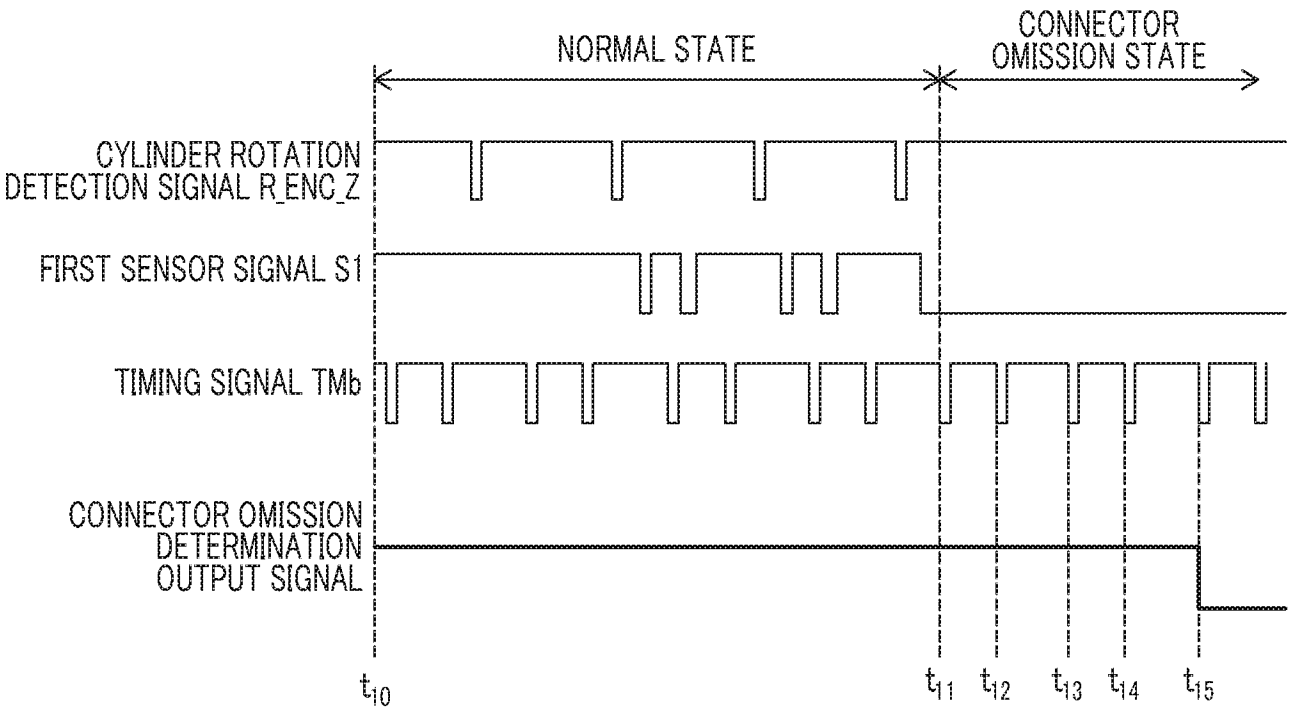
FIG. 8 is a timing chart illustrating output logics of the signals.

FIG. 7 is a flowchart illustrating processes of the connection status detection method according to the present embodiment. FIG. 8 is a timing chart illustrating output logics of signals. The signals include the cylinder rotation detection signal R_ENC_Z, the first sensor signal S1, the timing inversion signal TMb, and the connector omission determination output signal. Also in the present embodiment, in a manner similar to that of the first embodiment, in the state where the ink jet recording apparatus 10 performs normal image recording, connection statuses of the second wire harness 94 and the second connector section 94*a* are detected.

At the beginning, the connector omission determination circuit 88 initializes a variable TMb_CNT, which is the number of falling edges of the timing inversion signal TMb, to 0 (step S11). The connector omission determination circuit 88 has a counter (not shown in the drawing) for counting the number of falling edges of the tinting inversion signal TMb, and clears the counted number of the counter to 0.

Next, it is determined whether or not the rising edge of a system clock Clk is detected (step S12). In a case where the rising edge of the system clock Clk is not detected, the current process returns to step S12. In a case where the rising edge is detected, the current process advances to step S13.

Next, it is determined whether or not the logic of the cylinder rotation detection signal R_ENC_Z is ON (H level)

(step S13). In a case where the logic of the cylinder rotation detection signal R_ENC_Z is OFF level), the current process returns to step S11, and the variable TMb_CNT is initialized to 0 again. Further, in a case of ON, the current process advances to step S14.

Next, it is determined whether or not the falling edge of the timing inversion signal TMb is detected (step S14). As described above, in the timing signal TM, an on-pulse is output once for each half rotation of the intermediate conveying drum 34*c*. Accordingly, in the timing inversion signal TMb, an off-pulse is output once for each half rotation of the intermediate conveying drum 34*c*.

In a case where the falling edge of the timing inversion signal TMb is not detected, the current process returns to step S12. In a case where the falling edge is detected, the current process advances to step S15.

In step S14, in a case where the falling edge of the timing inversion signal TMb is detected, the connector omission determination circuit 88 adds 1 to the variable TMb_CNT (step S15).

Subsequently, the connector omission determination circuit 88 determines whether or not the variable TMb_CNT is 4, that is, whether or not the falling edge of the timing inversion signal TMb is detected four times (an example of a plurality of detections) while the logic of the cylinder rotation detection signal R_ENC_Z is ON (step S16). In a case where the variable TMb_CNT is not 4, the current process returns to step S12, and the same processes are repeated. Further, in a case of 4, the current process advances to step S17.

In step S16, in a case where it is determined that the variable TMb_CNT is 4, the connector omission determination circuit 88 determines that an error such as disconnection of the second wire harness 94 or omission of the second connector section 94*a* occurs, and sets the logic of the connector omission determination output signal as OFF (step S17). Further, in response to the OFF state of the logic of the connector omission determination output signal, the ink jet recording apparatus 10 stops conveying the sheets of paper through the conveying section 28, the processing liquid coating drum 30, the intermediate conveying drum 34*a*, the image forming drum 36, the intermediate conveying drum 34*b*, the ink drying drum 38, the intermediate conveying drum 34*c*, the image fixing drum 40, and the pair of conveying rollers 26*b*. Simultaneously, a display device or an alarm device, which is not shown in the drawing, may notify that an error occurs.

In the example of FIG. 8, in the period of the timing $t_{10}$ to the timing $t_{11}$, sheets of paper are normally conveyed, and jam detection is performed. In this state, while the logic of the cylinder rotation detection signal R_ENC_Z is continuously ON, the falling edge of the timing inversion signal TMb occurs twice.

Thereafter, at the timing $t_{11}$, wiring errors of the second wire harness 94 and the second connector section 94*a* such as omission of the second connector section 94*a* occur. The connector omission determination circuit 88 is configured such that the logic of the cylinder rotation detection signal R_ENC_Z is set as ON in a case where omission of the second connector section 94*a* occurs.

In this state, if the rising edge occurs in the system clock Clk (not shown in the drawing), the result of the determination in step S12 is Yes, and the current process advances to step S13. At this time, the logic of the cylinder rotation detection signal R_ENC_Z is ON. Thus, the result of the determination in step S13 is Yes, and the current process advances to step S14.

In step S14, the result of the determination is No until the falling edge of the timing inversion signal TMb is detected, and the processes of steps S12 to S14 are repeated.

Thereafter, at the timing $t_{12}$, if the falling edge occurs in the timing inversion signal TMb, the result of the determination is Yes in step S14, and the current process advances to step S15. In step S15, the variable TMb_CNT is incremented, and then TMb_CNT=1.

Since the TMb_CNT is not 4, if the result of the determination in step S16 is No, the current process returns to step S12 again. Subsequently, if the rising edge occurs in the system clock Clk, the result of the determination in step S12 is Yes, the current process advances to step S13. Further, since the logic of the cylinder rotation detection signal R_ENC_Z is ON, the result of the determination in step S13 is Yes, and the current process advances to step S14.

In step S14, the result of the determination is No until the falling edge of the timing inversion signal TMb is detected, the processes of steps S12 to S14 are repeated.

Thereafter, at the timing $t_{13}$, if the falling edge occurs in the timing inversion signal TMb, the result of the determination is Yes in step S14. Then, the current process advances to step S15, the variable TMb_CNT is incremented, and TMb_CNT=2.

Since the TMb_CNT is not 4, if the result of the determination in step S16 is No, the current process returns to step S12 again. Hereinafter, likewise, until TMb_CNT becomes equal to 4, the processes of steps S12 to S16 are repeated.

If TMb_CNT becomes equal to 4, the result of the determination in step S16 is Yes. As a result, in step S17, the connector omission determination circuit 88 sets the logic of the connector omission determination output signal as OFF.

As described above, by using the signal which is input through the first wire harness 92 and the first connector section 92*a* different from the second wire harness 94 and the second connector section 94*a*, it is possible to detect the connection statuses of the second wire harness 94 and the second connector section 94*a*.

It is possible to adopt an aspect in which the connection status detection of the present embodiment is also performed in a state where sheets of paper are not conveyed. Further, in order to detect both the connection statuses of the first wire harness 92 and the first connector section 92*a* and the connection statuses of the second wire harness 94 and the second connector section 94*a*, the processes of the flowchart shown in FIG. 5 and the processes of the flowchart shown in FIG. 7 are performed simultaneously or alternately.

Here, the first sensor signal S1, the second sensor signal S2, and the clear signal CL used in the jam detection are input to the jam detection circuit 70 through the first wire harness 92 and the first connector section 92*a*, but may be input to the jam detection circuit 70 through the second wire harness 94 and the second connector section 94*a*. That is, the timing signal TM, which is used in the jam detection, and the cylinder rotation detection signal R_ENC_Z, which is for detecting the wiring state of the timing signal TM, may be input to the jam detection circuit 70 through a different wiring.

A technical scope of the present invention is not limited to the scope described in the above-mentioned embodiments. The configuration and the like of each embodiment may be appropriately combined without departing from the scope of the present invention.

EXPLANATION OF REFERENCES

10: ink jet recording apparatus
12: sheet feeding conveying section

14: processing liquid coating section
16: image forming section
18: ink drying section
20: image fixing section
21: discharging section
22: jam detection section
34*a*, 34*b*, 34*c*: intermediate conveying drum
36: image forming drum
38: ink drying drum
40: image fixing drum
56*a*, 56*b*, 56*c*: intermediate conveying section
64: hot-air nozzle
66: infrared rays (IR) heater
70: jam detection circuit
88: connector omission determination circuit
90: board
92: first wire harness
92*a*: first connector section
94: second wire harness
94*a*: second connector section
98: timing sensor
100: rotary encoder

What is claimed is:

1. A jam detection device comprising:

a synchronization signal generation unit that generates a conveying synchronization signal for synchronization with a conveying operation of a conveying device including a processing unit configured to process cut sheets while conveying the cut sheets, a first conveying unit configured to transfer the cut sheets to the processing unit, and a second conveying unit configured to receive the cut sheets from the processing unit;

a first detection sensor that is provided to face the first conveying unit and outputs a first output signal in response to passing of the cut sheets;

a second detection sensor that is provided to face the second conveying unit and outputs a second output signal in response to passing of the cut sheets;

a timing signal generation unit that generates a timing signal for defining detection timings of the first output signal and the second output signal;

a board to which the first output signal, the second output signal, and the timing signal are input;

a first wiring through which the timing signal is input to the board;

a second wiring through which the conveying synchronization signal is input to the board;

a conveying error detection unit that is disposed on the board and detects conveying errors of the cut sheets by detecting conditions of the first output signal and the second output signal at the detection timings; and a connection status detection unit that is disposed on the board and detects a connection status of the first wiring by comparing the conveying synchronization signal with the timing signal.

2. The jam detection device according to claim 1, wherein the connection status detection unit detects errors in the first wiring in a case where there is no change in the timing signal while the conveying synchronization signal is detected a plurality of times.

3. The jam detection device according to claim 1, wherein the connection status detection unit detects errors in the second wiring in a case where there is no change in the conveying synchronization signal while the timing signal is detected a plurality of times.

4. The jam detection device according to claim 1, wherein the board and the first wiring are connected through a connector.

5. The jam detection device according to claim 1, wherein the board and the second wiring are connected through a connector.

6. A conveying device comprising:

the jam detection device according to claim 1;

a processing unit that processes the cut sheets while conveying the cut sheets;

a first conveying unit that transfers the cut sheets to the processing unit; and a second conveying unit that receives the cut sheets from the processing unit.

7. The conveying device according to claim 6, wherein at least one of the processing unit, the first conveying unit, and the second conveying unit is a cylinder that conveys the cut sheets by rotating while holding the cut sheets on an outer circumferential surface thereof, and wherein the synchronization signal generation unit includes a rotary encoder that detects a rotation angle of the cylinder.

8. The conveying device according to claim 7, wherein the timing signal generation unit has a disk that rotates in synchronization with rotation of the cylinder, a dog that is provided on the disk, and a sensor that detects the dog.

9. The conveying device according to claim 6, wherein the processing unit has drying unit configured to heat and dry the cut sheets.

10. An image recording apparatus comprising:

the conveying device according to claim 6; and an image forming unit that forms an image by ejecting ink onto the cut sheets from an ink jet head while conveying the cut sheets, wherein the image forming unit transfers the cut sheets, on which images are recorded by the ink jet head, to the first conveying unit.

11. A connection status detection method comprising steps of:

generating a conveying synchronization signal for synchronization with a conveying operation of a conveying device, and inputting the conveying synchronization signal to a board through a second wiring, the conveying device including a processing unit configured to process cut sheets while conveying the cut sheets, a first conveying unit configured to transfer the cut sheets to the processing unit, and a second conveying unit configured to receive the cut sheets from the processing unit;

inputting a first output signal to the board in response to passing of the cut sheets by a first detection sensor that is provided to face the first conveying unit;

inputting a second output signal to the board in response to passing of the cut sheets by a second detection sensor that is provided to face the second conveying unit;

generating a timing signal for defining detection timings of the first detection sensor and the second detection sensor, and inputting the timing signal to the board through a first wiring;

detecting conveying errors of the cut sheets by detecting conditions of the first output signal and the second output signal, which are input to the board, at the detection timings; and detecting a connection status of the first wiring by comparing the conveying synchronization signal and the timing signal which are input to the board.

* * * * *